US006591841B1

(12) United States Patent
White et al.

(10) Patent No.: US 6,591,841 B1
(45) Date of Patent: Jul. 15, 2003

(54) METHOD OF PROVIDING FLAVORFUL AND AROMATIC TOBACCO SUSPENSION

(76) Inventors: Jackie Lee White, 4843 River Haven Rd., Pfafftown, NC (US) 27040; William Monroe Coleman, III, 2900 Loch Dr., Winston-Salem, NC (US) 27106; Thomas Albert Perfetti, 2116 Newcastle Dr., Winston-Salem, NC (US) 27103

( * ) Notice: Subject to any disclaimer, the term of this patent is extended or adjusted under 35 U.S.C. 154(b) by 14 days.

(21) Appl. No.: 09/993,755

(22) Filed: Nov. 14, 2001

Related U.S. Application Data

(63) Continuation-in-part of application No. 09/204,652, filed on Dec. 2, 1998, now abandoned, which is a continuation-in-part of application No. 08/691,158, filed on Aug. 1, 1996, now abandoned.

(51) Int. Cl.[7] ..... A24B 3/10
(52) U.S. Cl. ..... 131/300; 131/309; 131/310
(58) Field of Search ..... 131/290, 297, 131/303, 299, 369, 300, 309, 310

(56) References Cited

U.S. PATENT DOCUMENTS

| | | | | |
|---|---|---|---|---|
| 3,076,729 A | * | 2/1963 | Garbo | 131/290 |
| 3,424,171 A | | 1/1969 | Rooker | |
| 4,150,677 A | | 4/1979 | Osborne, Jr. et al. | |
| 4,281,671 A | | 8/1981 | Bynre et al. | |
| 4,506,682 A | | 3/1985 | Muller | |
| 4,537,204 A | | 8/1985 | Gaisch et al. | |
| 4,596,259 A | | 6/1986 | White et al. | |
| 4,605,016 A | | 8/1986 | Soga et al. | |
| 4,607,646 A | | 8/1986 | Lilly, Jr. et al. | |
| 4,708,151 A | | 11/1987 | Shelar | |
| 4,714,082 A | | 12/1987 | Banerjee et al. | |
| 4,756,318 A | | 7/1988 | Clearman et al. | |
| 4,771,795 A | | 9/1988 | White et al. | |
| 4,793,365 A | | 12/1988 | Sensabaugh, Jr. et al. | |
| 4,862,905 A | | 9/1989 | Green, Jr. et al. | |
| 4,882,128 A | | 11/1989 | Hukvari et al. | |
| 4,941,484 A | | 7/1990 | Clapp et al. | |
| 4,986,286 A | | 1/1991 | Roberts et al. | |
| 5,016,654 A | | 5/1991 | Bernasek et al. | |
| 5,038,802 A | | 8/1991 | White et al. | |
| 5,060,669 A | | 10/1991 | White et al. | |
| 5,099,862 A | | 3/1992 | White et al. | |
| 5,121,757 A | | 6/1992 | White et al. | |
| 5,131,415 A | | 7/1992 | Munoz et al. | |
| 5,159,942 A | | 11/1992 | Brinkley et al. | |
| 5,235,992 A | | 8/1993 | Sensabaugh, Jr. | |
| 5,318,050 A | | 6/1994 | Gonzalez-Parra et al. | |
| 5,413,122 A | | 5/1995 | Shu et al. | |
| 6,499,489 B1 | * | 12/2002 | Coleman | 131/309 |

FOREIGN PATENT DOCUMENTS

| | | |
|---|---|---|
| DE | 1 517 280 | 9/1969 |
| EP | 0 212 234 | 3/1987 |
| EP | 0 277 519 | 8/1988 |
| GB | 572236 | 7/1945 |
| GB | 1 383 029 | 2/1975 |

* cited by examiner

*Primary Examiner*—Steven P. Griffin
*Assistant Examiner*—Carlos Lopez
(74) *Attorney, Agent, or Firm*—Alston & Bird LLP

(57) ABSTRACT

Processes for producing flavorful and aromatic compounds from tobacco material are provided. The processes involve providing a tobacco suspension comprising finely ground tobacco material, and subjecting the tobacco suspension to heat treatment in an enclosed, pressure controlled, and generally inert environment at a temperature of at least 140° C.

29 Claims, 1 Drawing Sheet

METHOD OF PROVIDING FLAVORFUL AND AROMATIC TOBACCO SUSPENSION

RELATED APPLICATION

This application is a continuation-in-part application of U.S. application Ser. No. 09/204,652, filed Dec. 2, 1998 now abandoned, which is a continuation-in-part application of U.S. application Ser. No. 08/691,158, filed on Aug. 1, 1996 now abandoned, for Method of Providing Flavorful and Aromatic Compounds, both of which are hereby incorporated by reference herein in their entirety.

FIELD OF THE INVENTION

The present invention relates to methods for providing flavor and aroma substances, i.e. flavor additives, for tobacco materials, cigarettes and other smoking articles.

BACKGROUND OF THE INVENTION

Popular smoking articles, such as cigarettes have a substantially cylindrical rod shaped structure and include a charge of smokable material, such as shreds or strands of tobacco material (i.e., in cut filler form), surrounded by a paper wrapper, thereby forming a tobacco rod. It has become desirable to manufacture a cigarette having a cylindrical filter element aligned in an end-to-end relationship with the tobacco rod. Typically, a filter element includes cellulose acetate tow circumscribed by plug wrap, and is attached to the tobacco rod using a circumscribing tipping material. Many cigarettes include processed tobacco materials and/or tobacco extracts in order to provide certain flavorful characteristics to those cigarettes.

Many types of smoking products and improved smoking articles have been proposed through the years as improvements upon, or as alternatives to, the popular smoking articles. Recently, U.S. Pat. No. 4,708,151 to Shelar; U.S. Pat. No. 4,771,795 to White et al; U.S. Pat. No. 4,714,082 to Banerjee et al; 4,756,318 to Clearman et al; and U.S. Pat. No. 4,793,365 to Sensabaugh, Jr. et al; and European Patent Publication Nos. 212,234 and 277,519 propose cigarettes and pipes which comprise a fuel element, an aerosol generating means physically separate from the fuel element, and a separate mouth end piece. Such types of smoking articles provide natural tobacco flavors to the smoker thereof by heating, rather than burning, tobacco in various forms. Generally, natural tobacco flavors and aromas are important for the taste, aroma, and acceptance of smoking products, including substitute smoking materials. Thus, the search for natural tobacco flavor additives or flavor substances is a continuing task.

For example, U.S. Pat. No. 3,424,171 describes a process for the production of a non-tobacco smokable product having a tobacco taste. Tobacco is subjected to a moderate (i.e. below scorching) heat treatment i.e., at from about 175° C. to 200° C. (350° to 400° F.), to drive off aromatic components. These components are trapped on adsorbent charcoal, and removed from the charcoal by solvent extraction. The smokable product disclosed is vegetable matter, treated with the mixture of tobacco aromatic components and the solvent.

Similarly, U.S. Pat. No. 4,150,677 describes a process for the treatment of tobacco which comprises the steps of: (1) contacting tobacco which contains relatively high quantities of desirable flavorants with a stream of non-reactive gas, under conditions whereby the tobacco is heated in a temperature range from about 140° to 180° C.; (2) condensing the volatile constituents of the resulting gaseous stream; and (3) collecting said condensate. The condensate may be used subsequently to flavor a smoking material in order to enhance the organoleptic qualities of its smoke.

British Patent No. 1,383,029 describes a method of obtaining tobacco aroma substances which comprises an extraction treatment wherein the components of the tobacco that are soluble in a suitable solvent are extracted and the residue is obtained after removing the solvent is subjected to heat treatment at a temperature from 30° to 260° C.

U.S. Pat. No. 5,038,802 to White et al. and U.S. Pat. No. 5,016,654 to Bernasek et al. disclose extraction processes which heat tobacco and then pass an inert atmosphere through the heating chamber to collect volatiles from the tobacco. The volatiles are then fractionated in downstream operations, which include liquid sorbents, cold temperature traps, and filters.

U.S. Pat. No. 5,235,992 to Sensabaugh proposes a process that involves heating tobacco (e.g., in a flowing gas stream) during a first staged heating to a first "toasting" temperature to drive off volatile materials, increasing the toasting temperature during a second staged heating, and separately collecting, as flavor substances, at least portions of the volatile materials driven off at the first and second toasting temperatures.

U.S. Pat. No. 5,121,757 to White et al. proposes a process for altering the chemical nature of a tobacco extract, in which tobacco material is extracted with a chemical solvent, the extract is contacted with an ammonia compound, and the ammonia-treated extract is subjected to heat treatment in a pressure-controlled environment (e.g., in a Parr bomb).

While these processes have produced flavor substances acceptable for use in many smoking articles, they have either not been suitable for some smoking articles, or have necessarily required the forming of a tobacco extract prior to the obtaining of the desired compound. Additionally, many of these processes necessarily required expensive or inabundant starting materials. It would be highly desirable to provide a process for efficiently and effectively producing flavorful and aromatic compounds useful in the manufacture of smoking articles, which processes in particular could utilize more abundant starting materials and which would not require the additional steps necessary to form tobacco extractions.

SUMMARY OF THE INVENTION

It has now been discovered that flavorful and aromatic substances can be produced from tobacco materials previously thought to have little commercial value, for example, tobacco dust from the cigarette manufacturing process, without having to first perform extraction procedures on the materials. Other sources of tobacco dust can be used, such as finely ground tobacco leaves and stems. The flavorful and aromatic substances produced by the invention described herein possess aromatic qualities, total volatile profiles and individual volatile component profiles that are comparable to flavorful and aromatic substances obtained from the more time-consuming and resource-intensive extraction/heat treatment methods of the prior art.

The present invention generally relates to a process for the production of natural tobacco flavor substances useful in tobacco smoking products as flavor substances, and in tobacco substitute materials as a source of tobacco smoke flavor and/or aroma. The process of this invention produces suspensions having a complex mixture of volatile, semi-volatile, and non-volatile aroma/flavor components that are products of the Maillard reactions.

In particular, tobacco in the form of finely divided particles (finely around tobacco material) is produced from tobacco material and is mixed with an aqueous liquid to produce a tobacco suspension. This suspension is subjected to heat treatment in a pressure controlled environment (e.g., a Parr bomb) under conditions sufficient to alter the chemical nature (e.g., the flavor and aroma characteristics) of the finely ground tobacco material. Normally, the tobacco suspension is exposed to a temperature sufficiently high and for a period of time sufficiently long so as to provide an increase in aroma/flavor compounds. However, it is preferable that the tobacco suspension not be exposed to such a high temperature for a sufficiently long period of time so as to provide an aroma/flavor which exhibits a burnt or tarry aroma/flavor.

The finely ground tobacco material can be contacted with an aqueous liquid to comprise a tobacco suspension. The tobacco suspension should have sufficient aqueous liquid such that a liquid phase is present in the suspension. Typically the tobacco suspension can be 80% or less solids. More preferably, the suspension contains less than 50% solids and most preferably contains between 10% and 25% solids. Thus, for the purposes of this invention, it is convenient to refer to the heat treatment, or the moderately high temperature treatment, of a tobacco suspension. For the purposes of the invention, a tobacco suspension can include tobacco material in a dust or powder form contacted with an aqueous liquid further comprising additives (e.g., amino acids, amino acid analogs or amino acid sources or other nitrogen sources, and/or sugar or sugar sources).

Accordingly, the present invention more particularly relates to a process of producing a natural tobacco flavor or aroma by first contacting finely ground tobacco material with an aqueous liquid to provide an aqueous ground tobacco material suspension, which suspension is then subjected to heat treatment at a temperature significantly above about 140° C. in a pressure controlled and generally inert environment. In particular, it has been found that the amount of aromatic flavorants generated in the present invention is significantly increased when the temperature of the heat treatment is about 140° C. or higher. For example, heat treatment at 175° C. can produce about 6 times as much flavorful and aromatic materials as heat treatment at 121° C. Preferably the heat treatment is conducted at a temperature of exceeding 140° C., more preferably at least about 160° C., and most preferably at about 175° C.

Typically, the tobacco suspension is heated in a pressure controlled and generally inert environment. Thus, the heat treatment step of the present invention can be conducted in an inert gas or ambient air, and additional oxygen or an equivalent oxidizing agent is not required. In general, the pressure experienced by the ground tobacco material suspension is greater than ambient (i.e., atmospheric) pressure. Typical pressures experienced by the tobacco suspension during the process of the present invention in an enclosed vessel range from about 10 psig to about 1,000 psig, normally from about 20 psig to about 500 psig, preferably exceeding 100 psig.

The ground tobacco material suspension has a tobacco content of at least about 5 percent by weight, preferably at least about 10 percent by weight, and more preferably at least about 25 percent by weight, when the suspension is exposed to the moderately high temperature treatment. For purposes of this invention, the term "tobacco content" relates to the weight of the finely ground tobacco material within the ground tobacco material suspension relative to the total weight of the tobacco suspension.

The resulting flavorful and aromatic compositions are useful as casing or top dressing components for tobacco laminae and cut filler, as well as for other smokable material. Alternatively, such flavorful and aromatic compositions are useful in those types of smoking articles described in U.S. Pat. No. 4,708,151 to Shelar; U.S. Pat. No. 4,714,082 to Banerjee et al.; U.S. Pat. No. 4,756,318 to Clearman et al.; and U.S. Pat. No. 4,793,365 to Sensabaugh; as well as European Patent Publication Nos. 212,234 and 277,519.

The flavorful and aromatic compositions are also useful as cigarette filter additives. For example, the flavorful and aromatic compositions can be incorporated into low density polyethylenes and formed into strands, and then incorporated into cigarette filters as described in U.S. Pat. No. 4,281,671 to Byrne et al. and U.S. Pat. No. 4,862,905 to Green, Jr. et al. The flavorful and aromatic compositions are also useful as cigarette wrapper additives; or as additives to the inner regions of cigarette packages (e.g. within a paper/foil laminate of a cigarette package or within a low density polyethylene film which is placed within a cigarette package) in order to provide a desirable cigarette aroma and "pack aroma."

Flavor compounds produced by the methods of the present invention have organoleptic qualities and volatile content qualities that are comparable to those compounds produced by solvent extraction of natural compounds and heat treatments thereof.

Additionally, it has been found that tobacco materials formerly discarded as waste products of the manufacturing process may be used as starting materials in the process of the present invention to yield flavorful aromatic substances that are also comparative in concentration and desirable organoleptic qualities as other tobacco starting materials. Tobacco dust represents a significant portion of tobacco material lost during the manufacture of cigarettes. The present invention provides a heretofore unknown use for tobacco material as a source for aroma and flavor components for the manufacture of smoking articles and the like.

These and other advantages of the present invention are more completely illustrated in view of the accompanying drawings and detailed description of the invention which follows.

DETAILED DESCRIPTION OF THE INVENTION

Figure 1:
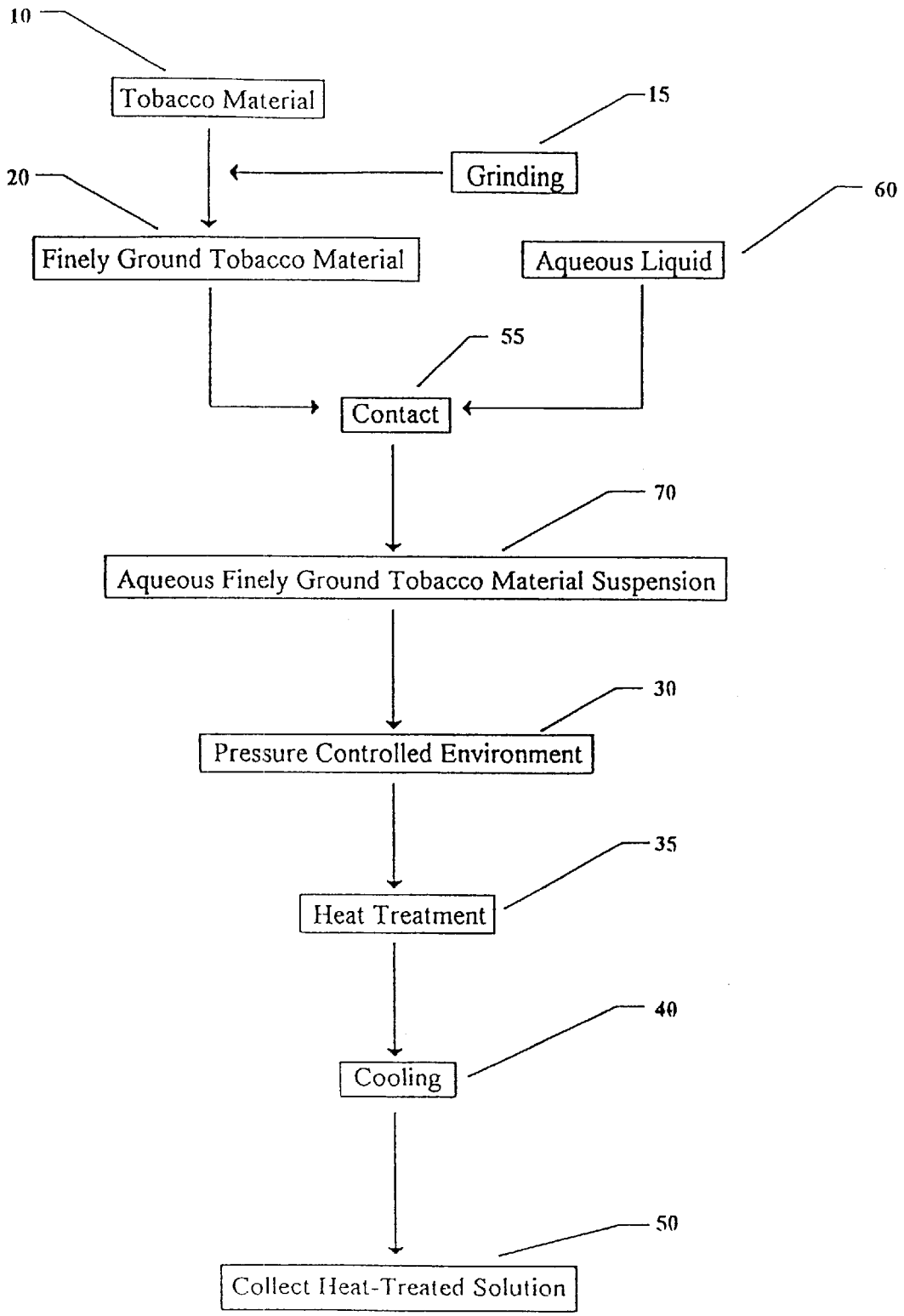
FIG. 1 is a schematic diagram of process steps representative of an embodiment of the present invention.

Referring now to FIG. 1, tobacco material 10 is subjected to grinding 15 to produce a finely ground tobacco material dust or powder 20. As used herein, the term "finely ground material" refers to materials composed of particles that are less than 10 mesh, preferably less than 20 mesh, and most preferably are less than 40 mesh (standard sieve size). Alternatively, the tobacco material may already be in dust form such that additional grinding is not necessary (i.e., the starting tobacco material is already finely ground). Although the preferred tobacco material is a dust or powder, other types of tobacco can be used, such as cut filler, strips, stems or leaves.

The finely ground tobacco material is then contacted 55 with an aqueous liquid (e.g., water) 60 to provide an aqueous tobacco suspension 70. This aqueous tobacco suspension is then placed in a pressure controlled environment 30, subjected to heat treatment 35, and cooled 40. The treated tobacco suspension is then collected 50 for use.

The tobacco materials useful herein can vary. Tobacco materials which are used are of a form such that upon grinding, the resulting ground material is in the form of finely divided particles. Examples of suitable tobaccos include Burley, Flue-Cured, Turkish, Latakia, Maryland Cigar, as well as the rare or specialty tobaccos, or blends thereof. Unaged, uncured, mature or immature tobaccos may also be employed. Tobacco waste materials such as fines, dust, scrap, stem, and stalk can be employed. In one preferred embodiment of the present invention, the tobacco material comprises a cigarette manufacturing by-product known to the skilled practitioner as cigarette dust. The aforementioned tobacco materials may be processed separately, or as blends thereof.

The tobacco material may be subjected to various means to reduce its size, such as grinding, such that the resulting tobacco material is in finely ground or powder form. Various grinding techniques will be apparent to one skilled in the art, and may include the use of e.g., ball mills or hammer mills. The grinding may also be carried out under vibrating or agitating conditions, the selection of said conditions being within the skill of one in the art.

The tobacco suspension may be provided in a number of ways. In particular, the finely ground tobacco material may be contacted with a liquid having an aqueous character, thus providing an aqueous ground tobacco material suspension. Such a liquid consists primarily of water, normally greater than about 90 weight percent water, and can be essentially pure water in certain circumstances. For example, a liquid having an aqueous character can be distilled water, tap water, or the like. However, a liquid having an aqueous character can include water having substances such as pH buffers, pH adjusters, organic and inorganic acids, bases and salts, or sugars, amino acids or surfactants incorporated therein. The liquid also can be a mixture of water and minor amounts of one or more solvents which are miscible therewith (e.g., various alcohols, polyols or humectants such as glycerin or polypropylene glycol). When the finely ground tobacco material is provided as a suspension in an aqueous liquid, the tobacco content of the suspension may be at least about 5 percent of the total suspension by weight, preferably at least about 10 percent by weight, and more preferably at least about 25 percent by weight.

The tobacco suspension can also be contacted with at least one amino acid, amino acid analog or amino acid source (e.g., glutamine, asparagine, proline, alanine, cystine, aspartic acid, phenylalanine, glutamic acid) and at least one sugar or sugar source (e.g., fructose, sucrose, glucose, maltose).

If desired, flavoring agents (e.g., cocoa, licorice, St. John's bread, spices, herbs, and the like) can also be added to the tobacco suspension.

The tobacco suspension is subjected to a heat treatment such as generally described in U.S. Pat. No. 5,060,669 to White et al., the disclosure of which is incorporated herein by reference in its entirety. In accordance with the present invention, the total yield of flavorful and aromatic materials in the suspension is significantly enhanced by conducting the heat treatment at a temperature of about 140° C. or higher. In particular, as can be seen in the Examples given below, when all other conditions are same, the amount of aromatic flavorants generated at a temperature of about 140° C. or higher is significantly greater than the amount produced at 121 ° C. Thus, preferably the heat treatment is conducted at a temperature of at least about 140° C., more preferably at least about 160° C. However, it is desirable to subject the tobacco suspension to a temperature below about 250° C., more desirably below about 200° C., in order to avoid an undesirable formation of components which are deleterious to the taste characteristics of the tobacco composition. Most preferably the tobacco suspension is subjected to a temperature of about 175° C.

The moderately high temperature treatment of the tobacco suspension can be performed under a generally inert atmosphere. The term "generally inert" is intended to mean that the heat treatment can be performed in an inert gas or under ambient atmosphere, i.e., air. When the tobacco suspension is subjected to heat treatment in ambient air, no additional oxygen or equivalent oxidizing agent is necessary. For example, there is no need for highly concentrated oxygen obtained by dissolving oxygen in high pressure ambient gases. When an inert atmosphere is desired for the heat treatment, an atmosphere that is inert, i.e., non-reactive, with respect to the tobacco materials in the suspension, under the particular heat treatment conditions, is employed. Inert gases, e.g. nitrogen, argon, or carbon dioxide gas can be used in order to provide an inert atmosphere. Alternatively, a hydrocarbon gas such as methane, ethane or butane, or a fluorocarbon gas, can also provide an atmosphere which is inert with respect to the materials in the tobacco suspension under the treatment conditions.

The moderately high temperature treatment is performed in a pressure controlled environment. Such an environment is provided by enclosing the tobacco suspension in an air sealed vessel or chamber. Typically, a pressure controlled environment is provided using a pressure vessel or chamber which is capable of withstanding relatively high pressures. Such vessels or chambers (i) provide enclosure or concealment of the tobacco suspension such that volatile flavor components of the tobacco suspension are not lost or do not otherwise escape during the moderately high temperature treatment step, and (ii) provide for treatment of the tobacco suspension at a temperature significantly above about 125° C. Preferred pressure vessels are equipped with an external heating source. Examples of vessels which provide a pressure controlled environment include a high pressure autoclave from Berghof/America Inc. of Concord, Calif., and Parr Reactor Model Nos. 4522 and 4552 available from The Parr Instrument Co. and described in U.S. Pat. No. 4,882,128 to Hukvari et al. Operation of such exemplary vessels will be apparent to the skilled artisan. Typical pressures experienced by the tobacco suspension during the process of the present invention in such vessels range from about 10 psig to about 1,000 psig, normally from about 20 psig to about 500 psig, preferably exceeding 100 psig.

The amount of time that the tobacco suspension is subjected to the moderately high temperature treatment can vary. Normally, the time period is sufficient to heat an entire tobacco suspension at the desired temperature for a period of at least about 10 minutes, preferably at least about 20 minutes. Normally, the time period is less than about 3 hours, preferably less than about 1 hour, and most preferably is about 30 minutes. However, it is desirable to control the time/temperature profile of tobacco suspensions subjected to heat treatment so that each tobacco suspension is not subjected to a particularly high temperature for a lengthy period of time. It is highly desirable to employ a pressure vessel design or a vessel equipped with an agitation mechanism such that the tobacco suspension experiences a relatively uniform temperature throughout the treatment period. In particular, it is highly desirable for the entire tobacco suspension to be heated uniformly throughout as much as possible at the maximum temperature to which the tobacco suspension is subjected.

Conditions provided during the process of the present invention most desirably are such that certain components of the tobacco suspension (e.g., free amino acid pools and naturally occurring sugars) undergo the Maillard Reactions. The Maillard Reactions or "browning reactions" are reactions between (i) the amino substituents of amino acids, peptides, proteins or other nitrogen-containing compounds, and (ii) the carbonyl group of a sugar in the reducing form or other carboxyl-containing compounds which are indigenous or added to the tobacco suspension. Such reactions result in a significant darkening of the tobacco suspension, typically to an extremely dark brown color. See, Maillard, *Ana. Chim.,* Vol. 9, pp. 5 and 258 (1916); Hodge, *J. Agric. Food Chem.,* Vol. 1, p. 928 (1953); Nursten, *Food Chem.,* Vol.6, p. 263(1981) and Waller et al, *ACS Symp. Ser.* (1983).

The treated tobacco suspension is useful in the manufacture of smoking articles. They may be added to conventional cigarettes or other smoking articles as a top dressing, or casing, or in any convenient mode selected by the manufacturer. The amount of the treated tobacco suspension employed per cigarette or smoking article can vary. For example, in a typical cigarette having about 0.6 to about 1 g per rod of smoking material, about 0.1 to 10% by weight, preferably about 0.5 to 6% by weight, of the heat treated suspension, can be used as a top dressing or casing.

Moreover, the treated tobacco suspension may be used as a filter flavor material for a cigarette. The suspension may be used to provide flavor/aroma to any of the forms of material that are used in the manufacture of tobacco products such as cigars, cigarettes, smoking tobacco or snuffs.

The present invention is more fully illustrated by the following examples, which are set forth to illustrate the present invention and are not to be construed as limiting thereof. In the following examples, mg means milligram, μg means micrograms, g means grams, L means liters, mL means milliliters, min means minutes, and mm means millimeters.

Example 1

Tobacco in the form of cigarette dust was ground on a SWECO vibrating ball mill (SWECO Inc., Los Angeles, Calif. USA) until it was reduced to a very fine powder. 150 g of the ground cigarette dust was mixed with 1350 g of water. This suspension was reacted in a sealed Parr bomb at 175° C. for 30 minutes. After a rapid cooling to ambient temperature, the remaining pressurized volatiles were released and the liquid was removed from the Parr bomb. A very aromatic aroma was observed coming from the liquid. This procedure was repeated with the starting materials of Burley tobacco dust, flue-cured tobacco dust, and Turkish tobacco dust.

Example 2

Tobacco in the form of cigarette dust was ground as described in Example 1. 375 g of the ground tobacco material was mixed with 1125 g of water to provide a suspension. This suspension was reacted in a Parr bomb at 175° C. for 30 minutes. After cooling and venting as described above, a very powerful aroma was noted. This procedure was repeated with the starting materials of Burley tobacco dust, flue-cured tobacco dust, and Turkish tobacco dust.

Example 3

Dynamic headspace/gas chromatography/mass selective detection/flame ionization detection (P&T/GC/MSD/FID) analyses were performed on the aromatic liquids produced as in Examples 1 and 2 using a TEKMAR (Cincinnati, Ohio, USA) LSC 2000 equipped with a TEKMAR 2016 heated sampling station. To 1.0 mL of sample, either control compounds or heat-treated samples in 5 mL Sparge tube (TEKMAR) was added 1.0 mL of an aqueous solution containing cyclohexanone at 21.3 μg/mL. Four or five analyses of each sample were performed to obtain adequate values for precision measurements. The samples were each preheated at 70° C. for 5 minutes prior to being swept for 10 minutes with a stream of helium at 40 mL/min. The sample temperature was held at 70° C. The volatiles were trapped on a Tenax (TEKMAR) trap and were then thermally desorbed onto the GC column set at 10° C. by heating at 180° C. for 5 minutes. The TEKMAR headspace system was directly interfaced with to a Hewlett-Packard 5880 gas chromatograph (GC) equipped with a DB 1701 fused silica column (J&W Scientific, Folsom, Calif.) 30 meters long, 0.32 mm inner diameter, and 1 micron film thickness. The outlet of the column was split between a flame ionization detector (FID) and a mass selective detector (MSD) operating in the electron impact mode at 70 V. The GC injection port, the MSD interface, and the FID detector were set at 250° C. After the transfer was complete, the column oven was programmed from 10° C. to 47° C. at 2° C. per minute followed by 10° C. per minute to 240° C. The FID area counts for cyclohexanone were employed in the calculation of the amount of each identified volatile component. The volatile components were identified from both mass spectral library search routines and GC retention time databases.

In Table 1, below, each identified volatile components from the cigarette dust, Burley tobacco dust, flue-cured tobacco dust, and Turkish tobacco dust is presented as an average concentration of the component over five samples, in μg/mL. In Table 2, each identified volatile component from the four kinds of dust used is presented as an average percentage distribution of the component over five samples. In both Tables, C2 pyrazines mean pyrazines with 2 carbons attached (e.g., dimethylpyrazine); C3 pyrazines mean pyrazines with 3 carbons attached (e.g., ethylmethylpyrazines); C4 pyrazines mean pyrazines with 4 carbons attached (e.g., ethyldimethylpyrazines).

TABLE 1

AVERAGE CONCENTRATION OF VOLATILES IN TREATED TOBACCO SUSPENSIONS

| Compound | 10% C-Dust | 10% Burley Dust | 10% Flue-Cured Dust | 10% Turkish Dust |
|---|---|---|---|---|
| 2-methylpropanal | 15.36 | 9.69 | 24.50 | 24.04 |
| methylfuran isomer | 5.21 | 2.29 | 6.44 | 5.57 |
| methylfuran isomer | 0.99 | 0.53 | 0.79 | 0.97 |
| 2-butanone | 10.18 | 9.05 | 10.97 | 10.50 |
| 2,3-butanedione | 9.89 | 6.79 | 15.83 | 14.65 |
| 3-methylbutanal | 16.24 | 13.55 | 20.84 | 20.96 |
| 2-methylbutanal | 10.06 | 8.17 | 13.37 | 11.97 |
| dimethylfuran | 0.62 | 0.31 | 0.51 | 2.15 |
| 2,3-pentanedione | 4.16 | 2.65 | 7.23 | 7.78 |
| pyrazine | 0.29 | 0.71 | 0.46 | 0.53 |
| 2-methyl-2-butenal | 1.50 | 3.88 | .038 | 0.72 |
| pyridine | 0.16 | 0.83 | 2.91 | 2.20 |
| methylpyrazine | 2.09 | 3.65 | 2.65 | 1.96 |
| 1H-pyrrole | 0.92 | 1.52 | 0.85 | 3.60 |
| furfural | 18.05 | 5.57 | 47.06 | 43.91 |
| C2 pyrazines | 2.49 | 4.84 | 1.60 | 1.76 |
| 2-furanmethanol | 0.73 | 0.55 | 0.82 | 1.35 |
| 2-acetylfuran | 1.43 | 0.45 | 2.59 | 1.19 |
| 6-methyl-2-heptanone | 0.91 | 0.52 | 0.58 | 3.16 |

TABLE 1-continued

AVERAGE CONCENTRATION OF VOLATILES IN TREATED TOBACCO SUSPENSIONS

| Compound | 10% C-Dust | 10% Burley Dust | 10% Flue-Cured Dust | 10% Turkish Dust |
|---|---|---|---|---|
| limonene | 0.29 | 0.33 | 0.36 | 1.37 |
| C3pyrazines | 2.72 | 4.45 | 2.79 | 1.28 |
| benzaldehyde | 1.25 | 1.32 | 0.35 | 1.31 |
| 5-methylfurfural | 17.43 | 10.00 | 34.48 | 33.07 |
| C4 pyrazines | 0.82 | 1.82 | 1.00 | 0.36 |
| benzeneacetaldehyde | 1.78 | 1.23 | 2.27 | 2.80 |
| methoxyphenol | 0.49 | 0.85 | 0.50 | 0.66 |
| menthol | 2.81 | 0.74 | .030 | 0.50 |
| 1-(3-methylphenyl)-ethanone | 0.99 | 0.48 | .050 | 1.90 |
| solanone | 7.09 | 5.92 | 2.22 | 5.30 |
| β-damascenone | 1.01 | 0.54 | 0.68 | 1.49 |
| neophytadiene | 0.67 | 1.78 | 1.66 | 0.95 |

TABLE 2

AVERAGE PERCENTAGE DISTRIBUTION OF VOLATILES IN TREATED TOBACCO SUSPENSIONS

| Compound | 10% C-Dust | 10% Burley Dust | 10% Flue-Cured Dust | 10% Turkish Dust |
|---|---|---|---|---|
| 2-methylpropanal | 8.83 | 7.44 | 10.24 | 9.52 |
| methylfuran isomer | 2.99 | 1.76 | 2.69 | 2.21 |
| methylfuran isomer | 0.57 | 0.41 | 0.33 | 0.38 |
| 2-butanone | 5.86 | 6.95 | 4.59 | 4.16 |
| 2,3-butanedione | 5.70 | 5.22 | 6.62 | 5.80 |
| 3-methylbutanal | 9.35 | 10.41 | 8.72 | 8.30 |
| 2-methylbutanal | 5.79 | 6.27 | 5.59 | 4.74 |
| dimethylfuran | 0.36 | 0.24 | 0.21 | 0.85 |
| 2,3-pentanedione | 2.40 | 2.04 | 3.02 | 3.08 |
| pyrazine | 0.17 | 0.54 | 0.19 | 0.21 |
| 2-methyl-2-butenal | 0.86 | 2.97 | 0.16 | .028 |
| pyridine | 0.10 | 0.64 | 1.21 | 0.87 |
| methylpyrazine | 1.20 | 2.81 | 1.11 | 0.78 |
| 1H-pyrrole | 0.53 | 1.16 | 0.35 | 1.43 |
| furfural | 10.41 | 4.29 | 19.68 | 17.42 |
| C2 pyrazines | 1.44 | 3.72 | 0.67 | 0.70 |
| 2-furanmethanol | 0.42 | 0.42 | 0.34 | 0.54 |
| 2-acetylfuran | 0.83 | 0.35 | 1.08 | 0.47 |
| 6-methyl-2-heptanone | .052 | 0.40 | 0.24 | 1.25 |

TABLE 2-continued

AVERAGE PERCENTAGE DISTRIBUTION OF VOLATILES IN TREATED TOBACCO SUSPENSIONS

| Compound | 10% C-Dust | 10% Burley Dust | 10% Flue-Cured Dust | 10% Turkish Dust |
|---|---|---|---|---|
| limonene | 0.17 | 0.25 | 0.15 | 0.54 |
| C3pyrazines | 1.26 | 3.42 | 1.17 | 0.51 |
| benzaldehyde | 0.58 | 1.02 | 0.16 | 0.52 |
| 5-methylfurfural | 10.05 | 7.69 | 14.42 | 13.12 |
| C4 pyrazines | 0.47 | 1.40 | 0.42 | 0.14 |
| benzeneacetaldehyde | 1.02 | 0.94 | 0.95 | 1.11 |
| methoxyphenol | 0.28 | 0.65° | 0.21 | 0.26 |
| menthol | 1.62 | 0.56 | 0.12 | 0.20 |
| 1-(3-methylphenyl)-ethanone | 0.57 | 0.37 | 0.21 | 0.75 |
| solanone | 4.08 | 4.53 | 0.93 | 2.10 |
| β-damascenone | 0.58 | 0.41 | 0.28 | 0.59 |
| neophytadiene | 0.38 | 1.35 | 0.70 | 0.38 |

Example 4

To compare the effect of temperature on the yield of flavorful and aromatic substances in the present invention, multiple suspensions were prepared as described in Examples 1 and 2 except that the ground tobacco C-Dust was 15% by weight in the suspensions. The suspensions were respectively reacted in a Parr bomb at 121° C. for 30 minutes, 121° C. for 3 hours, 140° C. for 30 minutes, 160° C. for 30 minutes, and 175° C. for 30 minutes. One suspension was unreacted and was used as a control. The Parr bomb reaction at 175° C. for 30 minutes was repeated with one additional suspension.

Dynamic headspace/gas chromatography/mass selective detection/flame ionization detection (P&T/GC/MSD/FID) analyses were performed on the aromatic liquid produced in these Parr bomb reactions as described in Example 3. Three analyses of each sample were performed to obtain adequate values for precision measurements. The results are shown in Table 3 below. In Table 3, each identified volatile components from the cigarette dust is presented as the concentration of the component in μg per gram of the heat treated tobacco suspension, based on the average of three analyses.

TABLE 3

AVERAGE CONCENTRATION OF VOLATILES IN TOBACCO SUSPENSIONS TREATED AT DIFFERENT TEMPERATURES

| compound | control | 121° C. 30' | 121° C. 3 hr | 140° C. 30' | 150° C. 30' | 175° C. 30' | 175° C. 30' |
|---|---|---|---|---|---|---|---|
| 2-propanal | 0.00 | 0.60 | 1.37 | 0.30 | 1.95 | 15.77 | 18.54 |
| methyl furan isomer | 0.00 | 0.29 | 0.44 | 0.41 | 0.39 | 2.29 | 4.05 |
| methyl furan isomer | 0.00 | 0.17 | 0.20 | 0.00 | 0.09 | 0.37 | 0.67 |
| 2-butanone | 0.00 | 0.00 | 0.00 | 0.00 | 0.00 | 0.00 | 0.00 |
| 2,3-butanedione | 0.00 | 0.00 | 0.00 | 0.00 | 0.00 | 0.00 | 0.00 |
| 3-methyl butanal | 0.00 | 0.92 | 1.84 | 0.43 | 2.15 | 15.19 | 17.81 |
| 2-methyl butanal | 0.00 | 0.48 | 1.02 | 0.14 | 1.46 | 11.39 | 13.07 |
| 2,3-penyanedione | 0.00 | 0.00 | 0.00 | 0.00 | 0.00 | 0.00 | 0.00 |
| pyrazine | 0.00 | 0.00 | 0.95 | 0.50 | 0.38 | 0.64 | 0.31 |
| pyridine | 0.00 | 0.00 | 0.36 | 0.43 | 0.30 | 3.06 | 0.68 |
| methylpyrazine | 0.53 | 0.62 | 8.56 | 38.33 | 2.75 | 8.96 | 2.42 |
| dihydro-2-methyl-3(2H)-furanone | 0.00 | 0.00 | 0.00 | 0.00 | 0.00 | 0.00 | 0.00 |
| pyrrole | 0.00 | 0.00 | 0.00 | 0.00 | 0.00 | 0.00 | 0.00 |
| fufural | 0.00 | 1.00 | 3.10 | 3.42 | 2.36 | 12.40 | 13.87 |
| C2 pyrazines | 0.20 | 0.41 | 1.41 | 20.47 | 1.20 | 8.40 | 2.48 |
| vinylpyrazine | 0.00 | 0.00 | 0.00 | 0.00 | 0.00 | 0.00 | 0.00 |

TABLE 3-continued

AVERAGE CONCENTRATION OF VOLATILES IN TOBACCO SUSPENSIONS TREATED AT DIFFERENT TEMPERATURES

| compound | control | 121° C. 30' | 121° C. 3 hr | 140° C. 30' | 150° C. 30' | 175° C. 30' | 175° C. 30' |
|---|---|---|---|---|---|---|---|
| acetyl furan | 0.00 | 0.28 | 0.75 | 0.34 | 0.28 | 1.38 | 1.75 |
| C3 pyrazines | 0.00 | 0.00 | 0.00 | 1.91 | 0.24 | 2.19 | 2.32 |
| benzaldehyde | 0.21 | 0.84 | 1.13 | 0.44 | 0.34 | 1.72 | 1.85 |
| 2-vinyl-8-methylpyrazine | 0.00 | 0.00 | 0.00 | 0.00 | 0.00 | 0.00 | 0.00 |
| 5-methylfurfural | 0.00 | 0.00 | 0.45 | 0.46 | 1.40 | 14.13 | 13.94 |
| C4 pyrazines | 0.00 | 0.00 | 0.00 | 0.37 | 0.11 | 0.62 | 0.34 |
| isopropenylpyrazine | 0.00 | 0.00 | 0.00 | 0.00 | 0.00 | 0.00 | 0.00 |
| benzeneacetaldehyde | 0.00 | 0.22 | 0.16 | 0.33 | 0.09 | 0.39 | 0.50 |
| C5 pyrazines | 0.00 | 0.00 | 0.00 | 0.00 | 0.05 | 0.46 | 0.00 |
| nicotine/solanone | 0.69 | 6.98 | 7.15 | 3.88 | 1.65 | 3.71 | 4.83 |
| Total Identified | 1.63 | 15.89 | 36.19 | 82.83 | 100.46 | 134.00 | 121.79 |
| Total FIO Area Count | 33.13 | 48.72 | 69.61 | 106.96 | 142.39 | 180.22 | 176.31 |
| Total Area Count w/o Internal Std. | 11.23 | 26.82 | 47.71 | 85.05 | 120.49 | 158.32 | 156.41 |

As can be seen from Table 3, heat treatment at 121° C. for 30 minutes only slightly increases the total counts of aromatic compounds. In addition, increasing the reaction time at 121° C. from 30 minutes to as much as 3 hours does not result in any significant increase in the production of the flavorful and aromatic compounds. In contrast, raising the temperature in the heat treatment leads to dramatic increase in the yield of desirable aromatic and flavorful compounds. For example, reacting the suspension at 140° C. for 30 minutes produces more than 3 times as much aromatic compounds as reacting at 121° C. for 30 minutes. The reaction at 175° C. for 30 minutes gives rise to 6 times as much aromatic compounds as the reaction at 121° C. for 30 minutes.

Example 5

A tobacco blend was prepared containing about 20 parts Burley tobacco, 55 parts flue-cured tobacco, and 25 parts Oriental tobacco, in the form of tobacco strips. The strip blend dry weight was approximately 2400 gm. To this blend of tobacco strips, a suspension of heat-treated tobacco dust was added. The suspension contained 10% tobacco dust and 90% water by weight (about 150 grams of tobacco dust and 1350 gm of water). After application of the suspension, the tobacco strips' final weight was about 2550 gm and contained 150 gm of the heat-treated tobacco suspension (approximately 5.8% by weight of the strip blend.)

The strip blend was cut at 32 cuts per inch at a moisture of approximately 18%. The cut filler was dried to approximately 13% in a heated pill coater drum. To this blend of cut filler material, it was added 2040 gm (40 parts) of expanded flue-cured tobacco cut filler and 510 gm (10 parts) of cut-rolled expanded stems.

The final blend was top-dressed with 1.5% by weight of glycerine containing a small amount of flavoring. The tobacco cut filler was used to prepare cigarettes that were 88 mm in length (57 mm tobacco rod wrapped with RJR Ref. 456 paper (Ecusta Corp., Pisgah Forest, N.C., USA) and a 27 mm shaped acetate filter from Filtron International Ltd. (Great Britain, code SAF). The cigarettes were ventilated at approximately 13 mm from the mouth-end. The average ventilation was about 55%. A total of five cigarettes were prepared in this manner, as follows:

Cigarette A: contained no heat-treated suspension applied to the strip blend; used as a control Cigarette B: contained a heat-treated suspension prepared from cigarette dust Cigarette C: contained a heat treated suspension prepared from Burley tobacco dust Cigarette D: contained a heat-treated suspension prepared from flue-cured tobacco dust Cigarette E: contained a heat-treated suspension prepared from Turkish tobacco dust.

All five cigarettes were submitted for FTC smoke analysis and had a tar yield per cigarette of about 10 mg. All of the cigarettes were tested against Cigarette A. All test cigarettes (B, C, D, E) delivered more tobacco taste, and were considered smoother and richer than the control cigarette. Additionally, the test cigarettes were preferred by individual smokers over Cigarette A. All four test products had a pleasant tobacco aroma.

The results of this experiment indicated that tobacco dust suspensions can be prepared and employed to enhance tobacco taste and aroma characteristics of cigarettes.

In the specification and examples, there have been disclosed preferred embodiments of the invention. Although specific terms are employed in these examples, they are used in a generic and descriptive sense only and not for the purpose of limitation, the scope of the invention being defined by the following claims.

That which is claimed is:

1. A process for altering the chemical nature of tobacco material, wherein said tobacco material has not been previously extracted, comprising subjecting a tobacco suspension comprising said tobacco material to heat treatment (i) in a pressure controlled and generally inert environment at a pressure greater than atmospheric pressure, and (ii) at a temperature of at least about 140° C. for a period of time sufficient to alter the chemical nature of the tobacco material; and applying the treated tobacco suspension to a smokable material.

2. The process according to claim 1, wherein said tobacco suspension is produced by contacting said tobacco material with an aqueous liquid.

3. The process according to claim 1, wherein the tobacco suspension contains 10 percent or greater tobacco material by weight.

4. The process according to claim 1, wherein the pressure controlled and generally inert environment is a closed system.

5. The process accordingly to claim 1, wherein said heat treatment is performed in an inert gas.

6. The process accordingly to claim 1, wherein said heat treatment is performed under ambient atmosphere in absence of increased oxygen concentration.

7. The process according to claim 1, wherein the tobacco suspension is subjected to heat treatment at a temperature of at least about 160° C.

8. The process accordingly to claim 1, wherein the tobacco suspension is subjected to heat treatment at a temperature of about 175° C.

9. The process according to claim 1, wherein the tobacco suspension is subjected to heat treatment at a pressure of about 10 psig to about 1000 psig.

10. The process according to claim 1, wherein the tobacco suspension is subjected to heat treatment at a pressure of about 20 psig to about 500 psig.

11. The process according to claim 1, wherein the tobacco suspension is subjected to heat treatment at a pressure exceeding 100 psig.

12. A process for altering the chemical nature of tobacco material, the process comprising the steps of:

(a) grinding tobacco material to provide finely ground tobacco material;

(b) contacting the finely ground tobacco material with an aqueous liquid to provide a tobacco suspension;

(c) subjecting the tobacco suspension to heat treatment (i) in a pressure controlled and generally inert environment at a pressure greater than atmospheric pressure, and (ii) at a temperature of at least about 140° C. so that the chemical nature of the tobacco material is altered; and (d) applying the treated tobacco suspension to a smokable material.

13. The process according to claim 12, wherein the tobacco suspension contains 10 percent or greater tobacco material by weight.

14. The process according to claim 12, wherein the pressure controlled and generally inert environment is a closed system.

15. The process according to claim 12, wherein said heat treatment is performed in an inert gas.

16. The process according to claim 12, wherein said heat treatment is performed under ambient atmosphere in absence of increased oxygen concentration.

17. The process according to claim 12, wherein the tobacco suspension is subjected to heat treatment at a temperature of at least about 160° C.

18. The process according to claim 12, wherein the tobacco suspension is subjected to heat treatment at a temperature of about 175° C.

19. The process according to claim 12, wherein the tobacco suspension is subjected to heat treatment at a pressure of about 20 psig to about 500 psig.

20. The process according to claim 12, wherein the tobacco suspension is subjected to heat treatment at a pressure exceeding 100 psig.

21. The process according to claim 1, wherein the smokable material comprises tobacco.

22. The process according to claim 1, wherein said applying step comprises applying the treated tobacco suspension to a smokable material in the form of a top dressing or casing.

23. The process according to claim 22, wherein the smokable material is tobacco laminae or cut filler.

24. The process according to claim 22, wherein the treated tobacco suspension is applied in an amount of about 0.1% to about 10% by weight of the smokable material.

25. The process according to claim 12, wherein the smokable material comprises tobacco.

26. The process according to claim 12, wherein said applying step comprises applying the treated tobacco suspension to a smokable material in the form of a top dressing or casing.

27. The process according to claim 26, wherein the smokable material is tobacco laminae or cut filler.

28. The process according to claim 26, wherein the treated tobacco suspension is applied in an amount of about 0.1% to about 10% by weight of the smokable material.

29. A process for altering the chemical nature of tobacco material, wherein said tobacco material has not been previously extracted, comprising subjecting a tobacco suspension comprising said tobacco material to heat treatment (i) in a pressure controlled and generally inert environment at a pressure of about 10 psig to about 1,000 psig, and (ii) at a temperature of at least about 160° C. for a period of time sufficient to alter the chemical nature of the tobacco material; and applying the treated tobacco suspension to a smokable material, wherein the smokable material comprises tobacco.

* * * * *

UNITED STATES PATENT AND TRADEMARK OFFICE

CERTIFICATE OF CORRECTION

PATENT NO. : 6,591,841 B1
DATED : July 15, 2003
INVENTOR(S) : White et al.

It is certified that error appears in the above-identified patent and that said Letters Patent is hereby corrected as shown below:

Column 9,
Table 1 - continued, third line under fourth sub-heading, “0.35” should read -- 0.38 --.

Signed and Sealed this

Eighteenth Day of November, 2003

JAMES E. ROGAN
*Director of the United States Patent and Trademark Office*